US009219961B2

(12) United States Patent
Osada

(10) Patent No.: US 9,219,961 B2
(45) Date of Patent: Dec. 22, 2015

(54) INFORMATION PROCESSING SYSTEM, COMPUTER-READABLE NON-TRANSITORY STORAGE MEDIUM HAVING STORED THEREIN INFORMATION PROCESSING PROGRAM, INFORMATION PROCESSING CONTROL METHOD, AND INFORMATION PROCESSING APPARATUS

(71) Applicant: NINTENDO CO., LTD., Kyoto (JP)

(72) Inventor: Junya Osada, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 389 days.

(21) Appl. No.: 13/867,509

(22) Filed: Apr. 22, 2013

(65) Prior Publication Data

US 2014/0112505 A1 Apr. 24, 2014

(30) Foreign Application Priority Data

Oct. 23, 2012 (JP) ..... 2012-234074

(51) Int. Cl.
*H04R 5/02* (2006.01)
*H04S 7/00* (2006.01)

(52) U.S. Cl.
CPC *H04R 5/02* (2013.01); *H04S 7/303* (2013.01); *H04S 7/304* (2013.01); *H04S 2400/11* (2013.01); *H04S 2400/13* (2013.01); *H04S 2400/15* (2013.01)

(58) Field of Classification Search
USPC ..... 381/1, 17, 18, 61, 300, 306, 307, 310
See application file for complete search history.

(56) References Cited

U.S. PATENT DOCUMENTS

| | | | | |
|---|---|---|---|---|
| 7,146,296 | B1 | 12/2006 | Carlbom et al. | |
| 2001/0011993 | A1 | 8/2001 | Saarinen | |
| 2004/0111171 | A1 | 6/2004 | Jang et al. | |
| 2009/0282335 | A1 * | 11/2009 | Alexandersson | 715/716 |
| 2010/0169103 | A1 | 7/2010 | Pulkki | |
| 2011/0138991 | A1 * | 6/2011 | Tsuchida | 84/602 |
| 2012/0002024 | A1 | 1/2012 | Choi et al. | |
| 2012/0114153 | A1 | 5/2012 | Yoo et al. | |
| 2012/0165095 | A1 | 6/2012 | Sato et al. | |
| 2013/0010969 | A1 * | 1/2013 | Cho et al. | 381/17 |
| 2013/0123962 | A1 | 5/2013 | Mizuta | |
| 2013/0225305 | A1 * | 8/2013 | Yang et al. | 473/152 |
| 2013/0279706 | A1 | 10/2013 | Marti | |

FOREIGN PATENT DOCUMENTS

JP 2012-135337 7/2012

OTHER PUBLICATIONS

United States Patent and Trademark Office, "Non-Final Office Action," issued in connection with U.S. Appl. No. 13/867,469, dated Jul. 6, 2015, 11 pages.
U.S. Appl. No. 13/867,469, filed Apr. 22, 2013.

* cited by examiner

*Primary Examiner* — Vivian Chin
*Assistant Examiner* — Friedrich W Fahnert
(74) *Attorney, Agent, or Firm* — Nixon & Vanderhye, P.C.

(57) ABSTRACT

In an exemplary information processing system including a plurality of sound output sections, the positional relationship among the plurality of sound output sections is recognized. In addition, a sound corresponding to a sound source object present in a virtual space is generated. The output volume of the sound for the sound source object is determined, for each sound output section, in accordance with the positional relationship among the plurality of sound output sections, and the generated sound is outputted in accordance with the output volume.

12 Claims, 16 Drawing Sheets

REAL SPACE COORDINATE SYSTEM

TERMINAL DEVICE COORDINATE SYSTEM

INFORMATION PROCESSING SYSTEM, COMPUTER-READABLE NON-TRANSITORY STORAGE MEDIUM HAVING STORED THEREIN INFORMATION PROCESSING PROGRAM, INFORMATION PROCESSING CONTROL METHOD, AND INFORMATION PROCESSING APPARATUS

CROSS REFERENCE TO RELATED APPLICATION

The disclosure of Japanese Patent Application No. 2012-234074, filed on Oct. 23, 2012, is incorporated herein by reference.

FIELD

The exemplary embodiments disclosed herein relate to an information processing system, a computer-readable non-transitory storage medium having stored therein an information processing program, an information processing control method, and an information processing apparatus, and more particularly, to an information processing system, a computer-readable non-transitory storage medium having stored therein an information processing program, an information processing control method, and an information processing apparatus, which are capable of outputting sound to a plurality of sound output sections.

BACKGROUND AND SUMMARY

Conventionally, a game system is known that uses, in combination, a general television apparatus (first video output apparatus) and a controller (second video output apparatus) having a display section capable of outputting video which is provided separately from the television apparatus. In such a game system, for example, a first game video is displayed on the television apparatus, and a second game video different from the first game video is displayed on the display section of the controller, thereby proposing a new pleasure.

However, the above proposal does not focus on what video to display mainly or how to associate these videos with game processing upon displaying them. Therefore, the proposal does not particularly mention or suggest processing relevant to sound.

Therefore, the exemplary embodiments are to describe an information processing system and the like that can provide a new experience giving a user an acoustic effect with a highly realistic sensation, using a plurality of loudspeakers.

The above feature can be achieved by the following configurations, for example.

As an exemplary configuration, an information processing system including a predetermined information processing section and a plurality of sound output sections will be shown. The information processing system includes a positional relationship recognizing section, a sound generation section, and a sound output control section. The positional relationship recognizing section recognizes the positional relationship among the plurality of sound output sections. The sound generation section generates a sound corresponding to a sound source object present in a virtual space, based on predetermined information processing. The sound output control section causes each of the plurality of sound output sections to output the generated sound therefrom. In addition, the sound output control section determines, for each of the plurality of sound output sections, the output volume of the sound corresponding to the sound source object in accordance with the positional relationship among the plurality of sound output sections.

According to the above exemplary configuration, an experience with an enhanced realistic sensation about a sound emitted by the sound source object can be provided for a user.

The information processing system may further include a first output apparatus and an orientation detection section. The first output apparatus has: a housing; a first display section and the plurality of sound output sections, which are integrated with the housing; and a motion sensor capable of detecting the motion of the first output apparatus. The orientation detection section detects the orientation of the first output apparatus based on an output from the motion sensor. The positional relationship may recognize section recognizes the positional relationship among the plurality of sound output sections based on the detected orientation of the first output apparatus. The sound output control section may determine the output volume of each sound output section based on the positional relationship among the plurality of sound output sections recognized based on the orientation of the first output apparatus.

According to the above exemplary configuration, by a player changing the orientation of the first output apparatus having the sound output sections, it becomes possible to perform sound output with an enhanced realistic sensation, with respect to a sound emitted by the sound source object.

The information processing section may execute predetermined information processing in the state in which the axis directions in the coordinate system of the virtual space coincide with the axis directions in the coordinate system of the real space. The virtual space containing the sound source object may be displayed on the first display section. The sound output control section may set the output volume such that, the closer the sound output section is to a position in the real space corresponding to the position of the sound source object in the virtual space, the larger the output volume of the sound output section is, and such that, the farther the sound output section is from the position in the real space, the smaller the output volume of the sound output section is.

According to the above exemplary configuration, for example, when the sound source object moves in the virtual space while emitting a sound, sound output can be performed with an enhanced realistic sensation about the movement.

The information processing system may further include a second output apparatus having: a plurality of sound output sections different from the plurality of sound output sections provided on the first output apparatus; and a second display section. The sound output control section may determine the output volume of each sound output section in accordance with the positional relationship among the plurality of sound output sections of the first output apparatus and the plurality of sound output sections of the second output apparatus.

According to the above exemplary configuration, it becomes possible to perform sound output with an enhanced realistic sensation by using a first pair of loudspeakers of the first output apparatus which can be used as a game controller, and a second pair of loudspeakers of the second output apparatus which can be used as a monitor, for example. For example, the loudspeakers of the first output apparatus may be in charge of the sound output relevant to the up-down direction as seen from a player, and the loudspeakers of the second output apparatus may be in charge of the sound output relevant to the right-left direction, whereby the player can feel the presence of the virtual space, i.e., a spatial sense.

The first output apparatus may further have a headphone connection section to which a headphone can be connected.

The information processing system may further include a headphone detection section configured to detect whether or not a headphone is connected to the first output apparatus. The sound output control section may, when it is detected that a headphone is connected to the first output apparatus, determine the output volume, regarding the positional relationship among the plurality of sound output sections as being a predetermined positional relationship, irrespective of the orientation of the first output apparatus.

According to the above exemplary configuration, for example, in the case where a player plays a game while wearing a headphone connected to the first output apparatus, a sound can be outputted without feeling of strangeness.

According to the exemplary embodiments, it becomes possible to perform sound output with an enhanced realistic sensation, with respect to a sound emitted by a sound source object present in a virtual space.

DETAILED DESCRIPTION OF NON-LIMITING EXAMPLE EMBODIMENTS

Figure 1:
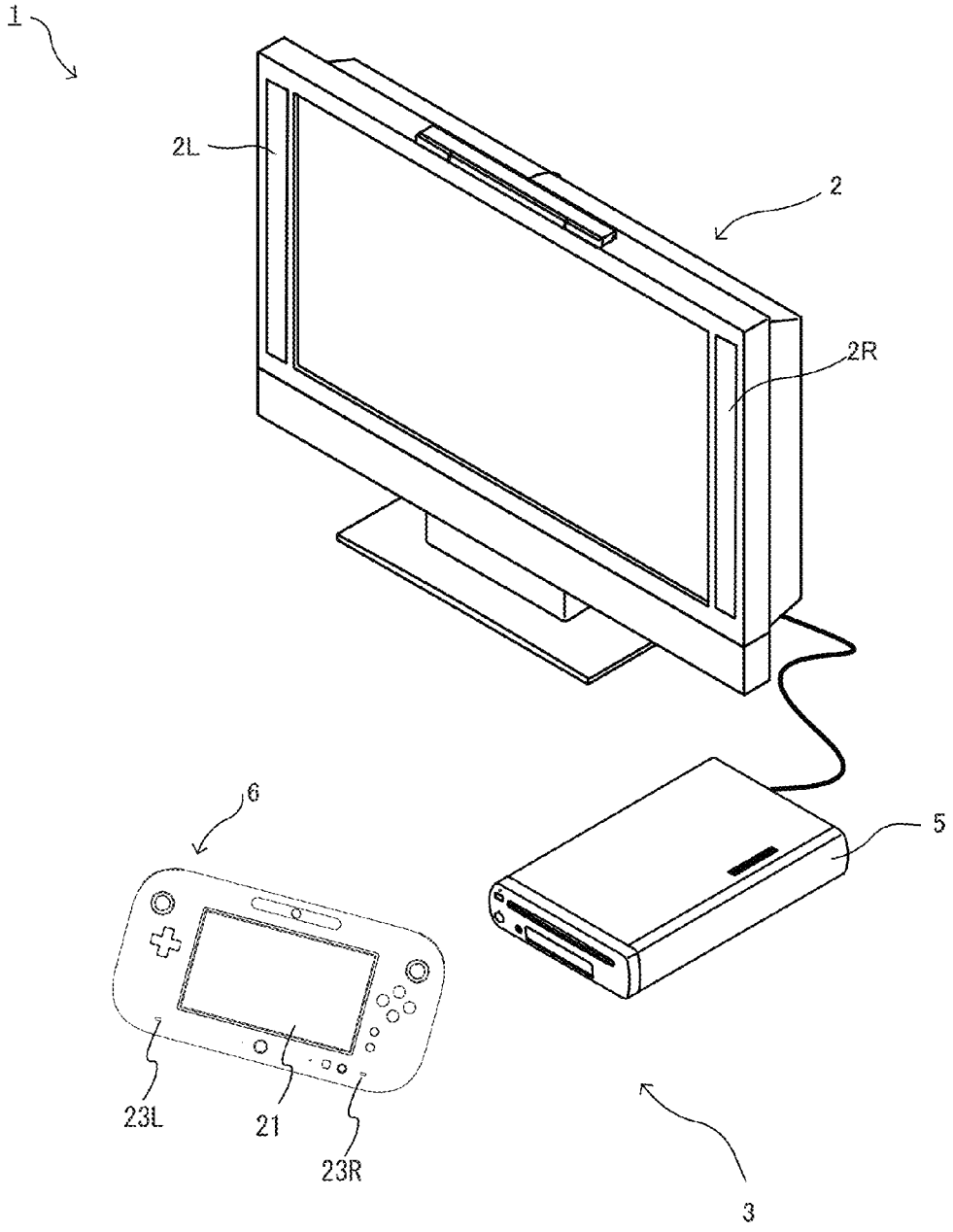
FIG. 1 is an external view showing a non-limiting example of a game system 1 according to an exemplary embodiment of the present disclosure.

With reference to FIG. 1, a game system according to an exemplary embodiment will be described.

As shown in FIG. 1, a game system 1 includes a household television receiver (hereinafter, referred to as a monitor) 2 that is an example of display means, and a stationary game apparatus 3 connected to the monitor 2 via a connection cord. The monitor 2 includes loudspeakers 2L and 2R which are stereo speakers having two channels. The game apparatus 3 includes a game apparatus body 5, and a terminal device 6.

The monitor 2 displays a game image outputted from the game apparatus body 5. The monitor 2 has the loudspeaker 2L at the left and the loudspeaker 2R at the right. The loudspeakers 2L and 2R each output a game sound outputted from the game apparatus body 5. In this exemplary embodiment, the monitor 2 includes these loudspeakers. Instead, external loudspeakers may be additionally connected to the monitor 2.

The game apparatus body 5 executes game processing and the like based on a game program or the like stored in an optical disc that is readable by the game apparatus body 5.

The terminal device 6 is an input device that is small enough to be held by a user. The user is allowed to move the terminal device 6 with hands, or place the terminal device 6 at any location. The terminal device 6 includes an LCD (Liquid Crystal Display) 21 as display means, loudspeakers 23L and 23R (hereinafter, may be collectively referred to as loudspeakers 23) which are stereo speakers having two channels, a headphone jack described later, input means (analog sticks, press-type buttons, a touch panel, and the like), and the like. The terminal device 6 and the game apparatus body 5 are communicable with each other wirelessly (or via a cable). The terminal device 6 receives, from the game apparatus body 5, data of an image (e.g., a game image) generated in the game apparatus body 5, and displays the image represented by the data on the LCD 21. Further, the terminal device 6 receives, from the game apparatus body 5, data of a sound (e.g., a sound effect, BGM or the like of a game) generated in the game apparatus body 5, and outputs the sound represented by the data from the loudspeakers 23, or if a headphone is connected, from the headphone. Further, the terminal device 6 transmits, to the game apparatus body 5, operation data representing the content of an operation performed on the terminal device 6.

Figure 2:
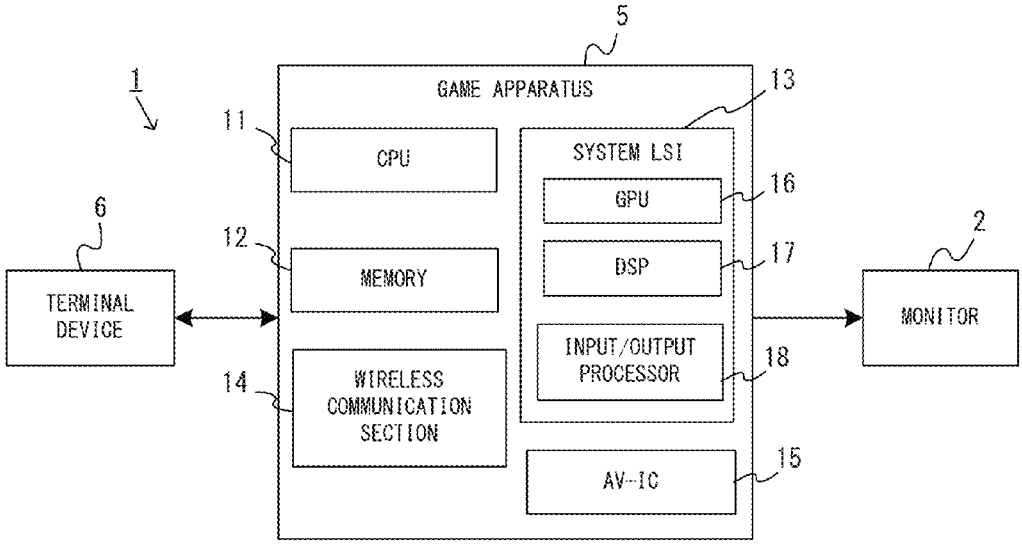
FIG. 2 is a function block diagram showing a non-limiting example of a game apparatus body 5 shown in FIG. 1.

FIG. 2 is a block diagram illustrating the game apparatus body 5. In FIG. 2, the game apparatus body 5 is an example of an information processing apparatus. In the exemplary embodiment, the game apparatus body 5 includes a CPU (control section) 11, a memory 12, a system LSI 13, a wireless communication section 14, and an AV-IC (Audio Video-Integrated Circuit) 15, and the like.

The CPU 11 executes a predetermined information processing program by using the memory 12, the system LSI 13, and the like. Thereby, various functions (e.g., game processing) in the game apparatus 3 are realized.

The system LSI 13 includes a GPU (Graphics Processor Unit) 16, a DSP (Digital Signal Processor) 17, an input/output processor 18, and the like.

The GPU 16 generates an image in accordance with a graphics command (draw command) from the CPU 11. In the exemplary embodiment, the game apparatus body 5 may generate both a game image to be displayed on the monitor 2 and a game image to be displayed on the terminal device 6. Hereinafter, the game image to be displayed on the monitor 2 may be referred to as a "monitor game image", and the game image to be displayed on the terminal device 6 may be referred to as a "terminal game image".

The DSP 17 serves as an audio processor, and generates sound data by using sound data and sound waveform (tone quality) data stored in the memory 12. In the exemplary embodiment, similarly to the game images, both a game sound to be output from the loudspeakers 2L and 2R of the monitor 2 and a game sound to be output from the loudspeakers 23 of the terminal device 6 (or a headphone connected to the terminal device 6) may be generated. Hereinafter, the game sound to be output from the monitor 2 may be referred to as a "monitor game sound", and the game sound to be output from the terminal device 6 may be referred to as a "terminal game sound".

The input/output processor 18 executes transmission and reception of data with the terminal device 6 via the wireless communication section 14. In the exemplary embodiment, the input/output processor 18 transmits data of the game image (terminal game image) generated by the GPU 16 and data of the game sound (terminal game sound) generated by the DSP 17, via the wireless communication section 14 to the terminal device 6. At this time, the terminal game image may be compressed and transmitted so as to avoid a delay in the display image. In addition, the input/output processor 18 receives, via the wireless communication section 14, operation data and the like transmitted from the terminal device 6, and (temporarily) stores the data in a buffer region of the memory 12.

Of the images and sounds generated in the game apparatus body 5, the image data and sound data to be output to the monitor 2 are read by the AV-IC 15. Through an AV connector that is not shown, the AV-IC 15 outputs the read image data to the monitor 2, and outputs the read sound data to the loudspeakers 2*a* included in the monitor 2. Thereby, an image is displayed on the monitor 2, and a sound is output from the loudspeakers 2*a*.

Figure 3:
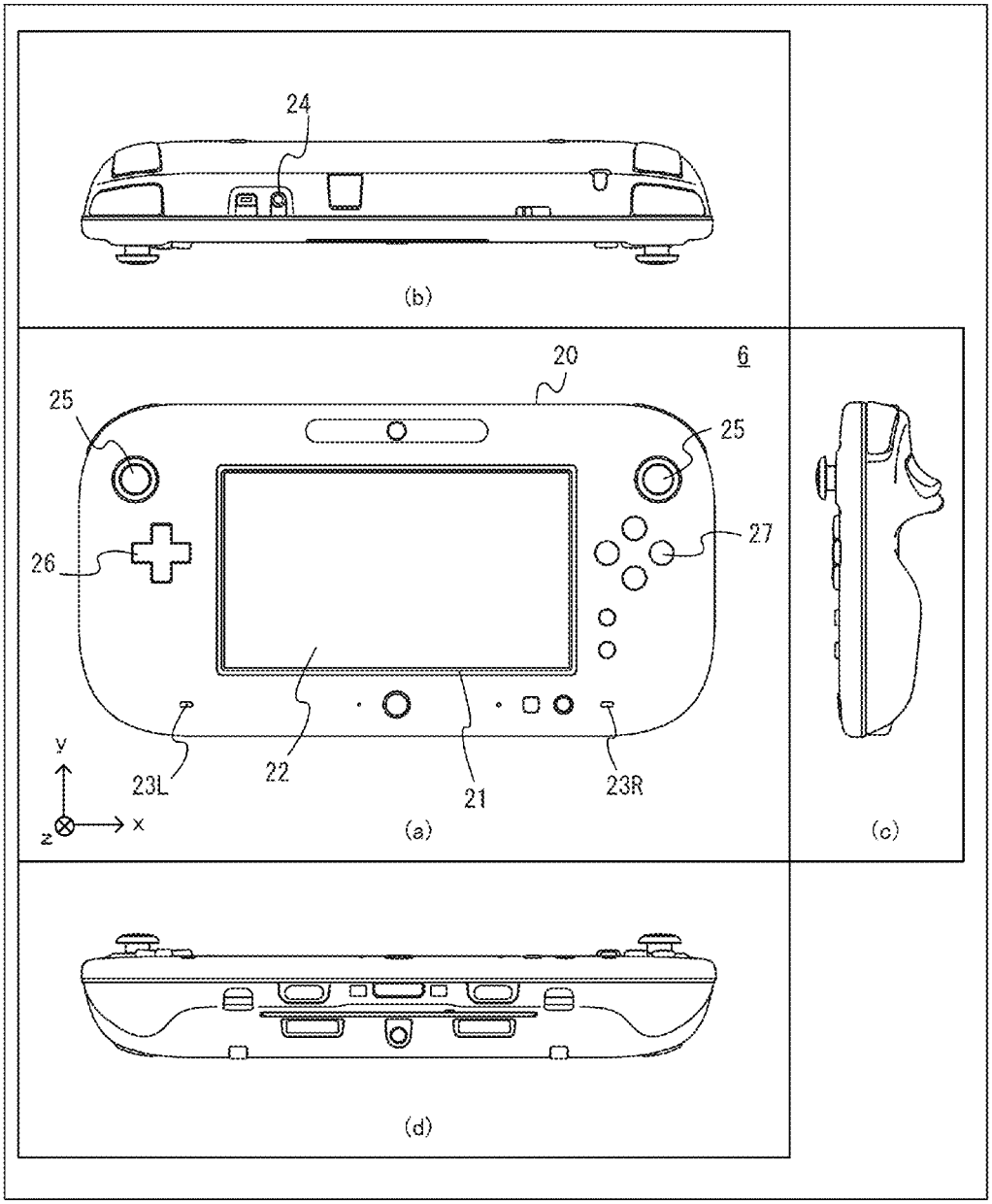
FIG. 3 is a diagram showing a non-limiting example of the external structure of a terminal device 6 shown in FIG. 1.

FIG. 3 is a diagram illustrating an example of an external structure of the terminal device 6. As shown in FIG. 3, the terminal device 6 includes a substantially plate-shaped housing 20. The size (shape) of the housing 20 is small enough to be held by a user with both hands or one hand. Further, the terminal device 6 includes an LCD 21 as an example of a display section. The above-mentioned terminal game image is displayed on the LCD 21.

The terminal device 6 includes the loudspeakers 23. The loudspeakers 23 are stereo speakers. The above-mentioned terminal game sound is outputted from the loudspeakers 23. In addition, the terminal device 6 includes a headphone jack 24 which allows a predetermined headphone to be attached and detached. Here, if a headphone is not connected to the headphone jack, the terminal device 6 outputs a sound from the loudspeakers 23, and if a headphone is connected to the headphone jack, the terminal device 6 does not output a sound from the loudspeakers 23. That is, in the exemplary embodiment, sound is not outputted from the loudspeakers 23 and the headphone at the same time, and thus the output from the loudspeakers 23 and the output from the headphone have a mutually exclusive relationship (in another embodiment, both outputs may be allowed at the same time).

The terminal device 6 includes a touch panel 22. The touch panel 22 is an example of a position detection section for detecting a position of an input performed on a predetermined input surface (a screen of the display section) provided on the housing 20. Further, the terminal device 6 includes, as an operation section (an operation section 31 shown in FIG. 4), analog sticks 25, a cross key 26, buttons 27, and the like.

Figure 4:
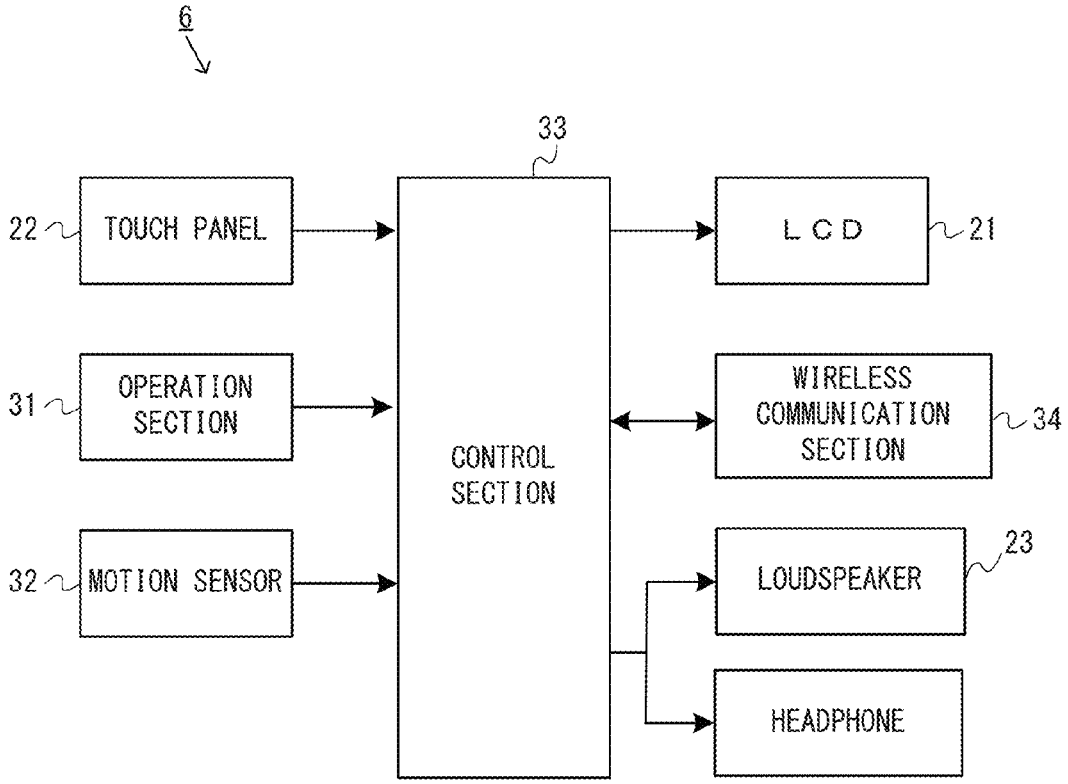
FIG. 4 is a block diagram showing a non-limiting example of the internal structure of the terminal device 6.

FIG. 4 is a block diagram illustrating an electrical configuration of the terminal device 6. As shown in FIG. 4, the terminal device 6 includes the above-mentioned LCD 21, touch panel 22, loudspeakers 23, volume control slider 28, and control section 31. In addition, a headphone can be connected to the terminal device 6 via the headphone jack 24. In addition, the terminal device 6 includes a motion sensor 32 for detecting the attitude of the terminal device 6. In the exemplary embodiment, an acceleration sensor and a gyro sensor are provided as the motion sensor 32. The acceleration sensor can detect accelerations on three axes of x, y, and z axes. The gyro sensor can detect angular velocities on three axes of x, y, and z axes.

The terminal device 6 includes a wireless communication section 34 capable of wirelessly communicating with the game apparatus body 5. In the exemplary embodiment, wireless communication is performed between the terminal device 6 and the game apparatus body 5. In another exemplary embodiment, wired communication may be performed.

The terminal device 6 includes a control section 33 for controlling operations in the terminal device 6. Specifically, the control section 33 receives output data from the respective input sections (the touch panel 22, the operation section 31, and the motion sensor 32), and transmits the output data as operation data to the game apparatus body 5 via the wireless communication section 34. In addition, the control section 33 detects the connection state of the headphone jack 24, and transmits data (detection result) indicating the connection state (connected/unconnected) which is also included in the operation data, to the game apparatus body 5. When the terminal game image from the game apparatus body 5 is received by the wireless communication section 34, the control section 33 performs, according to need, appropriate processes (e.g., decompression if the image data is compressed), and causes the LCD 21 to display the image from the game apparatus body 5. Further, when the terminal game sound from the game apparatus body 5 is received by the wireless communication section 34, if a headphone is not connected, the control section 33 outputs the terminal game sound to the loudspeakers 23, and if a headphone is connected, the control section 33 outputs the terminal game sound to the headphone.

Next, with reference to FIGS. 5 to 12, the summary of processing executed in the system of the exemplary embodiment will be described.

The processing performed in the exemplary embodiment is relevant to output control performed when a sound emitted by a sound source object present in a virtual 3-dimensional space (hereinafter, simply referred to as a virtual space) is outputted from a plurality of loudspeakers, e.g., stereo speakers (a pair of stereo speakers composed of two speakers at the left and right). Specifically, for such sound output, sound output control is performed taking into consideration the positional relationship among the loudspeakers in the real space. It is noted that the sound source object is defined as an object that can emit a predetermined sound.

Figure 5:
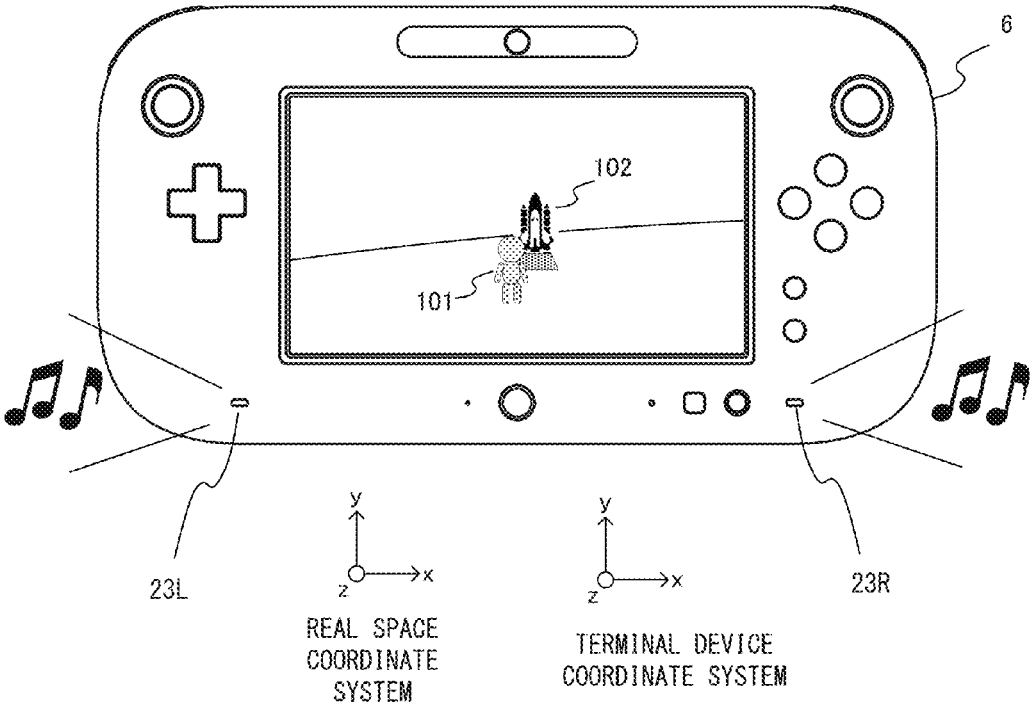
FIG. 5 is a diagram showing a non-limiting example of the output state of a game sound.

As an example of the processing of the exemplary embodiment, the following game processing will be assumed. That is, in a game realized by the present game processing, a player character can freely move in a virtual space. In this game, the virtual space, the player character, and the like are displayed on the LCD 21 of the terminal device 6. FIG. 5 is an example of a game screen displayed on the terminal device 6. In FIG. 5, a player character 101 and a sound source object 102 are displayed. In FIG. 5, the sound source object 102 has an external appearance like a rocket.

Here, in the present game, a game screen is displayed such that the coordinate system of the real space and the coordinate system of the virtual space always coincide with each other. In other words, the gravity direction is always perpendicular to a ground plane in the virtual space. In addition, the terminal device 6 has the motion sensor 32 as described above. By using this, the orientation of the terminal device 6 can be detected. Further, in the present game, in accordance with the orientation of the terminal device 6, a virtual camera is also inclined at the same time, whereby the terminal device 6 can be treated like a "peep window" for peeping into the virtual space. For example, as the orientation of the terminal device 6, it will be assumed that the terminal device 6 is grasped such that the LCD 21 thereof faces to the front of the player's face. At this time, it will be assumed that the virtual space in the positive direction of the z axis is displayed on the LCD 21. From this state, if the player turns 180 degrees to face right backward, the virtual space in the negative direction of the z axis will be displayed on the LCD 21.

In the display system for the virtual space as described above, for example, the case where the orientation of the terminal device 6 is such that the terminal device coordinate system and the real space coordinate system coincide with each other, will be assumed as shown in FIG. 5. Hereinafter, this orientation is referred to as "horizontal orientation". Further, in this orientation, it will be assumed that the sound source object 102 (rocket) shown in FIG. 5 takes off. Along with the movement of the sound source object 102 when taking off, a predetermined sound effect (for example, a rocket movement sound) is reproduced as a terminal game sound. That is, the sound source object 102 moves while emitting a sound. The way in which the sound is heard at this time (how the sound is outputted) is as follows. That is, in the state shown in FIG. 5 (at the beginning when the rocket takes off), the sound source object 102 is displayed substantially at the center of the LCD 21. Therefore, a sound from the loudspeaker 23L and a sound from the loudspeaker 23R are outputted substantially at the same volume. In the case of indicating the volume by 10 grades of 1 to 10, for example, both sounds are outputted at the volumes of loudspeaker 23L=6: loudspeaker 23R=6.

Figure 6:
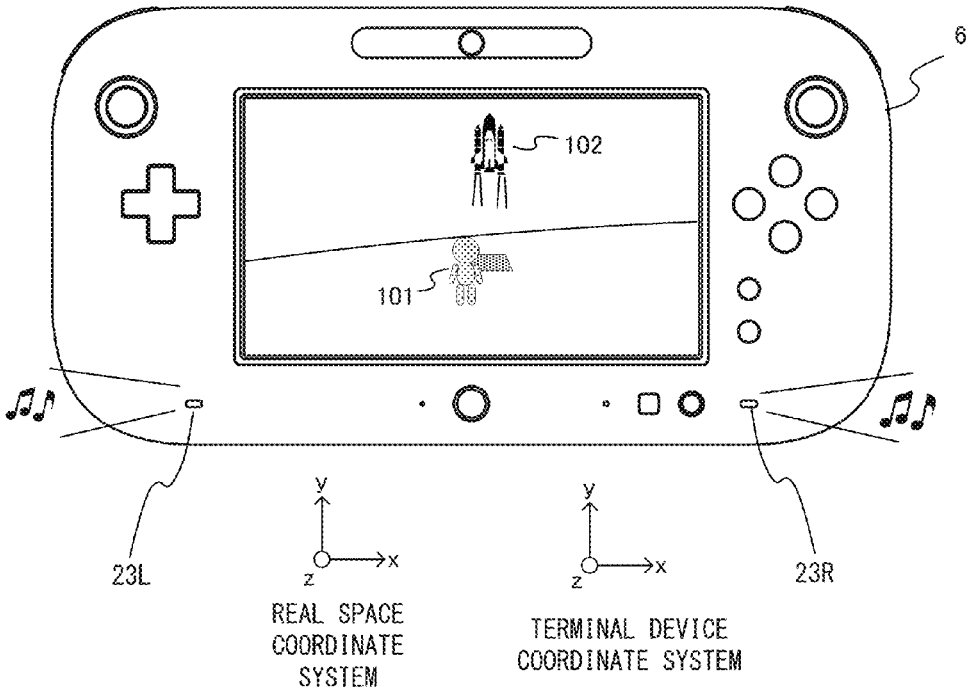
FIG. 6 is a diagram showing a non-limiting example of the output state of a game sound.

Thereafter, as shown in FIG. 6, as the sound source object 102 moves upward (in the positive direction of the y axis) in the virtual space, the sound source object 102 and the player character 101 become distant from each other. In order to reflect, in sound, such a scene in which the rocket having taken off gradually becomes away, the volume is adjusted so as to gradually reduce the movement sound of the rocket. Here, the volume adjustment is performed equally between the loudspeakers 23L and 23R. In other words, the volume balance between the left and right loudspeakers does not change while the volume of the movement sound of the rocket reduces as a whole. That is, upon movement of the sound source object in the vertical direction, the sound output control is performed without changing the volume balance between the left and right loudspeakers.

It is noted that when the terminal device 6 is in the "horizontal orientation", if the sound source object moves in the horizontal direction, the volume balance between the loudspeakers 23L and 23R is adjusted along with the movement. For example, if the sound source object moves from the right to the left so as to move across in front of the player character 101, the sound from the loudspeakers 23 is heard so as to move from the right to the left. That is, the volume balance is controlled such that the volume of the loudspeaker 23R gradually decreases while the volume of the loudspeaker 23L gradually increases.

Figure 7:
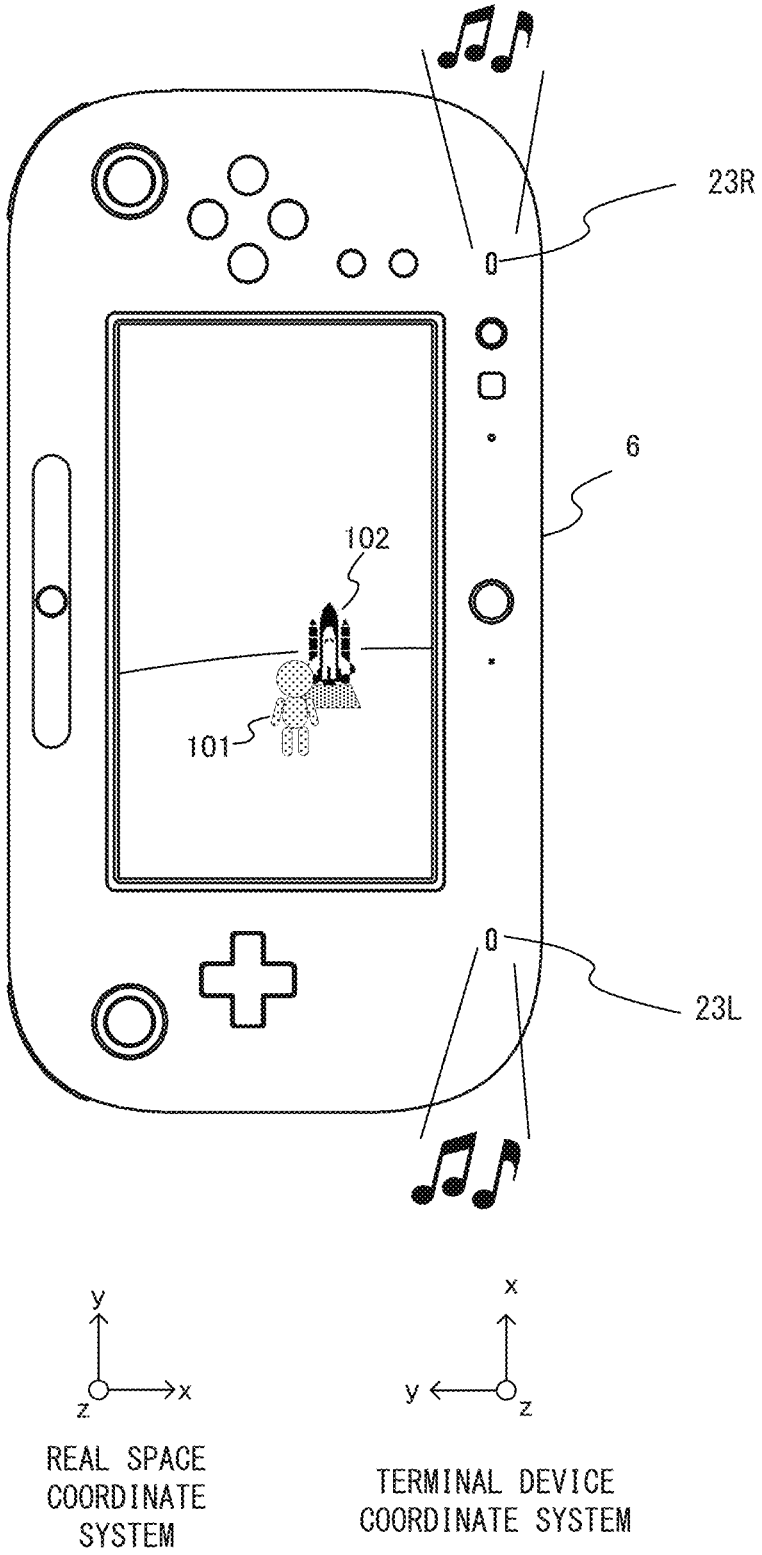
FIG. 7 is a diagram showing a non-limiting example of the output state of a game sound.

Next, it will be assumed that the terminal device 6 is turned 90 degrees leftward from the state shown in FIG. 5. FIG. 7 is a diagram showing the turned terminal device 6 and a game screen displayed at this time. Along with the turn of the terminal device 6, the positional relationship between the loudspeakers 23 also turns 90 degrees leftward. That is, the loudspeaker 23L is positioned on the lower side as seen from the player, and the loudspeaker 23R is positioned on the upper side as seen from the player. Hereinafter, this state is referred to as a "vertical orientation". Then, in this state, if the sound source object 102 moves upward while emitting a sound, the movement sound of the rocket is outputted while the volume balance between the loudspeakers 23L and 23R changes.

Figure 8:
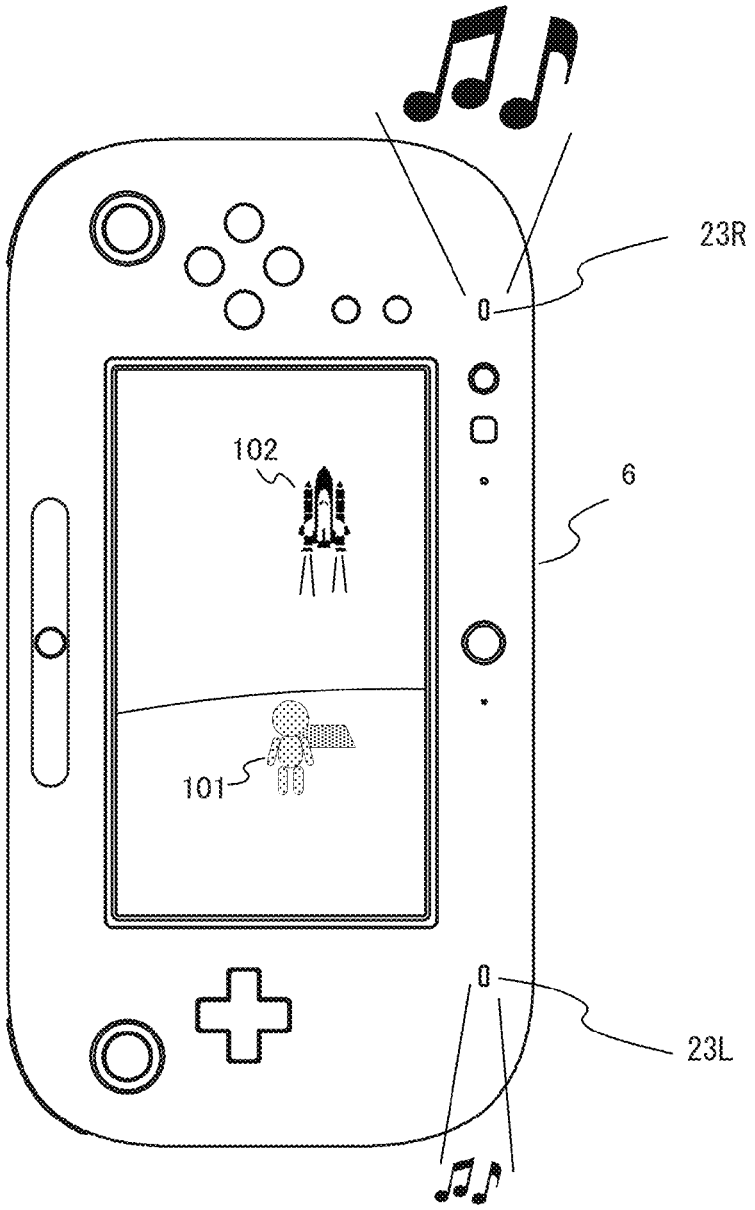
FIG. 8 is a diagram showing a non-limiting example of the output state of a game sound.
Figure 8:
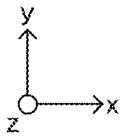
Figure 8:
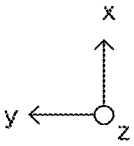

For example, in FIG. 7, the sound source object 102 is being displayed at a position slightly lower than the center of the screen. In this state, the movement sound of the rocket is outputted such that the volume of the loudspeaker 23L is slightly larger than the volume of the loudspeaker 23R. For example, at this point of time, it will be assumed that the movement sound is outputted at the volumes of loudspeaker 23L=6: loudspeaker 23R=5. Thereafter, as shown in FIG. 8, as the sound source object 102 moves upward, the volume of the movement sound of the rocket at the loudspeaker 23L gradually decreases and the volume of the movement sound of the rocket at the loudspeaker 23R gradually increases. For example, the volume of the loudspeaker 23L gradually decreases from 6 to 0 while the volume of the loudspeaker 23R gradually increases from 5 to 10.

Thus, in the exemplary embodiment, in the output control for the loudspeakers 23 with respect to a sound emitted from the sound source object 102 present in the virtual space, the positional relationship between the loudspeakers 23L and 23R in the real space is reflected. As a result, for example, when the rocket takes off, if the player changes the orientation of the terminal device 6 from "horizontal orientation" to "vertical orientation", an acoustic effect with a highly realistic sensation can be obtained.

Figure 9:
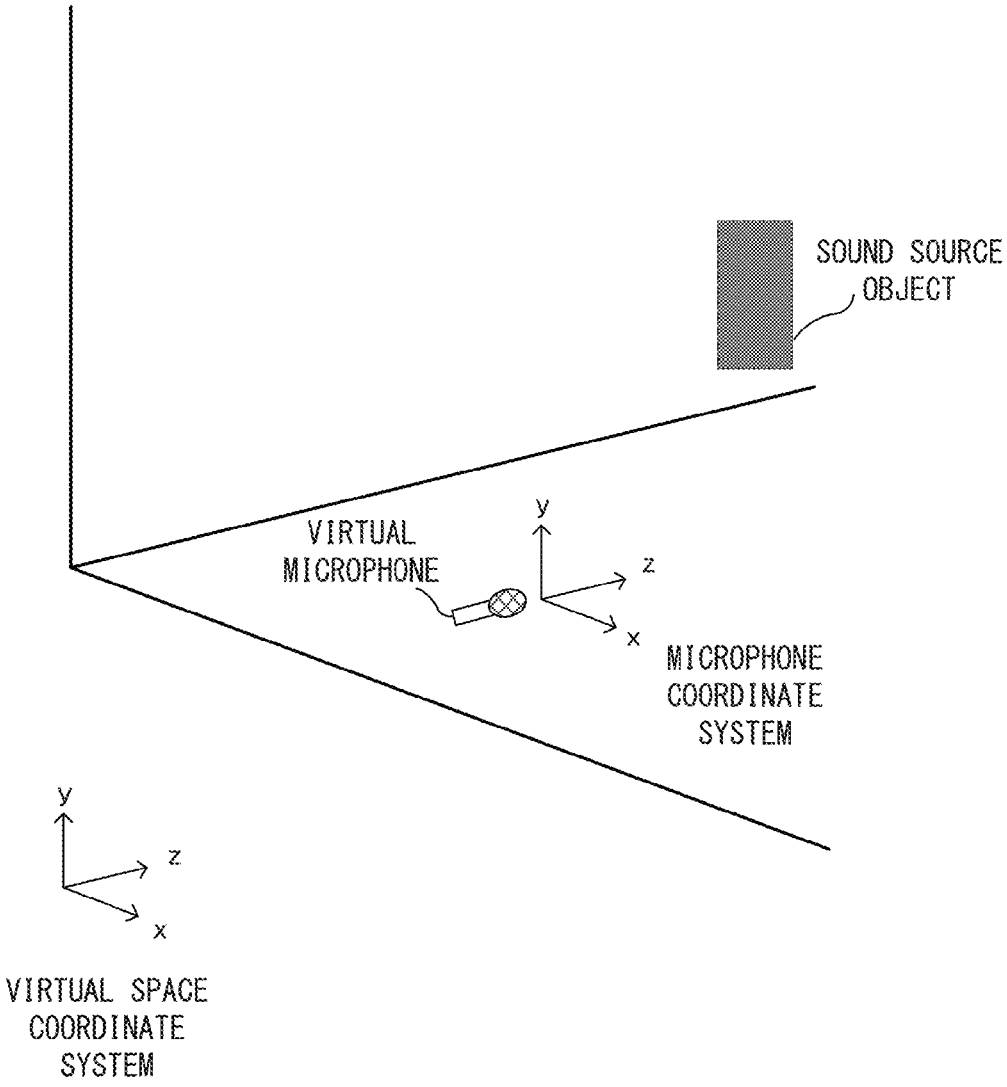
FIG. 9 is a non-limiting exemplary diagram for explaining the orientation of a virtual microphone.
Figure 10:
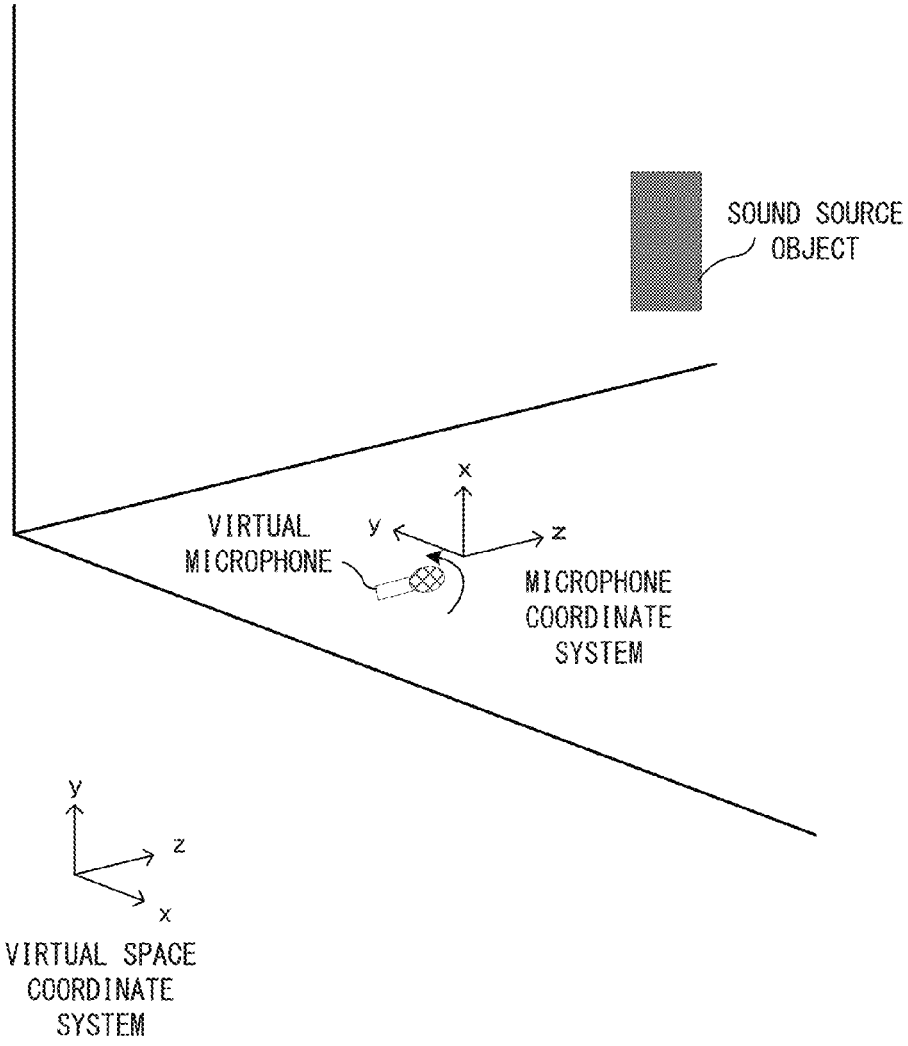
FIG. 10 is a non-limiting exemplary diagram for explaining the orientation of a virtual microphone.

In the exemplary embodiment, the above sound control is roughly realized by the following processing. First, a virtual microphone is placed at a predetermined position in the virtual space, typically, the position of the player character 101. In the exemplary embodiment, the virtual microphone picks up a sound emitted by the sound source object 102, and the sound is outputted as a game sound. A microphone coordinate system as a local coordinate system is set for the virtual microphone. FIG. 9 is a schematic diagram showing the relationship between the virtual space and the virtual microphone. In FIG. 9, the directions of the axes in the space coordinate system of the virtual space respectively coincide with the directions of the axes in the microphone coordinate system (the initial state at the start of a game is such a state). From the positional relationship between the virtual microphone and the sound source object 102 in the microphone coordinate system, it can be recognized whether the sound source object 102 is positioned on the right side or the left side as seen from the virtual microphone. Specifically, whether the sound source object is positioned on the right side or the left side as seen from the virtual microphone can be determined based on whether the position of the sound source object is in the positive region or the negative region on the x axis in the virtual microphone coordinate system, and then the volume balance between the left and right loudspeakers can be determined based on the determined positional relationship. In addition, the distance from the virtual microphone to the sound source object in the virtual space can be also recognized. Thus, the volume of each of the loudspeakers 23L and 23R (the volume balance between left and right) can be adjusted. Further, in the exemplary embodiment, in accordance with the orientation of the terminal device 6, the orientation of the virtual microphone is also changed. For example, it will be assumed that the orientation of the terminal device 6 has changed from the "horizontal orientation" shown in FIG. 5 to the "vertical orientation" shown in FIG. 7. In this case, along with this change, the orientation of the virtual microphone also turns 90 degrees leftward around the z axis. As a result, as shown in FIG. 10, the x axis direction of the microphone coordinate system corresponds to the y axis direction of the virtual space coordinate system. In this state, if the sound output control processing is performed with reference to the microphone coordinate system, the above-described control can be realized. That is, since the loudspeakers 23L and 23R are fixedly provided on the terminal device 6 (housing 20), if the orientation of the terminal device 6 is recognized, the positional relationship between the loudspeakers 23 can be also recognized. Therefore, if the orientation of the terminal device 6 is reflected in the orientation of the virtual microphone, change in the positional relationship between the loudspeakers 23 can be reflected, too.

Here, in the exemplary embodiment, two virtual microphones are used, e.g., a virtual microphone for generating a terminal game sound (hereinafter, referred to as a terminal virtual microphone), and a virtual microphone for generating a monitor game sound (hereinafter, referred to as a monitor virtual microphone) are used. It is noted that the processing according to the exemplary embodiment is mainly performed for the loudspeakers 23L and 23R of the terminal device 6. Therefore, in the following description, in the case of simply mentioning "virtual microphone" or "microphone coordinate system", it basically refers to the terminal virtual microphone.

Figure 11:
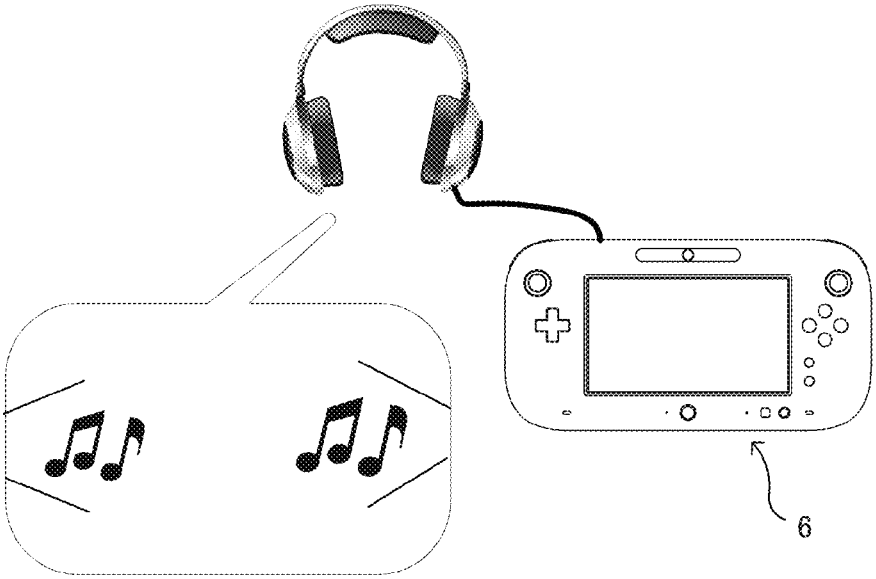
FIG. 11 is a diagram showing a non-limiting example of the output state of a game sound.
Figure 12:
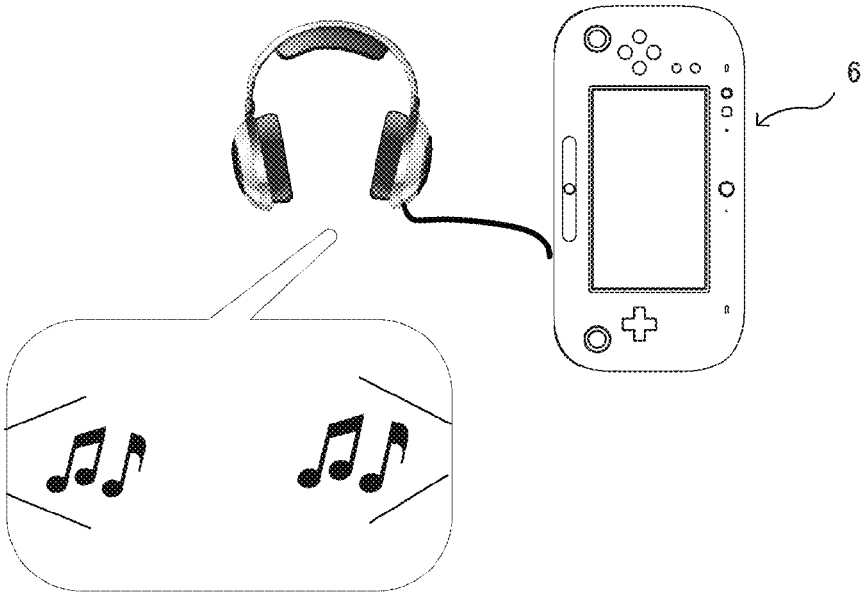
FIG. 12 is a diagram showing a non-limiting example of the output state of a game sound.

It is noted that when a headphone is connected to the terminal device 6, the processing is performed always regarding the loudspeakers being arranged at the left and right irrespective of the orientation of the terminal device 6. Specifically, when a headphone is connected, the x axis direction of the microphone coordinate system is always made to coincide with the x axis direction of the space coordinate system of the virtual 3-dimensional space. FIGS. 11 and 12 are schematic diagrams showing the way of sound output when a headphone is connected. In FIG. 11, the terminal device 6 is in "horizontal orientation". In addition, in FIG. 12, the terminal device 6 is in "vertical orientation". In any case, the sound output processing is performed without changing the orientation of the virtual microphone. As a result, even when the terminal device 6 is in "vertical orientation", the sound output processing is performed in the same manner as in the case of "horizontal orientation". That is, when a headphone is connected, the above-described sound output processing is performed regarding the terminal device 6 as being in "horizontal orientation".

Next, with reference to FIGS. 13 to 17, the operation of the system 1 for realizing the above-described game processing will be described in detail.

Figure 13:
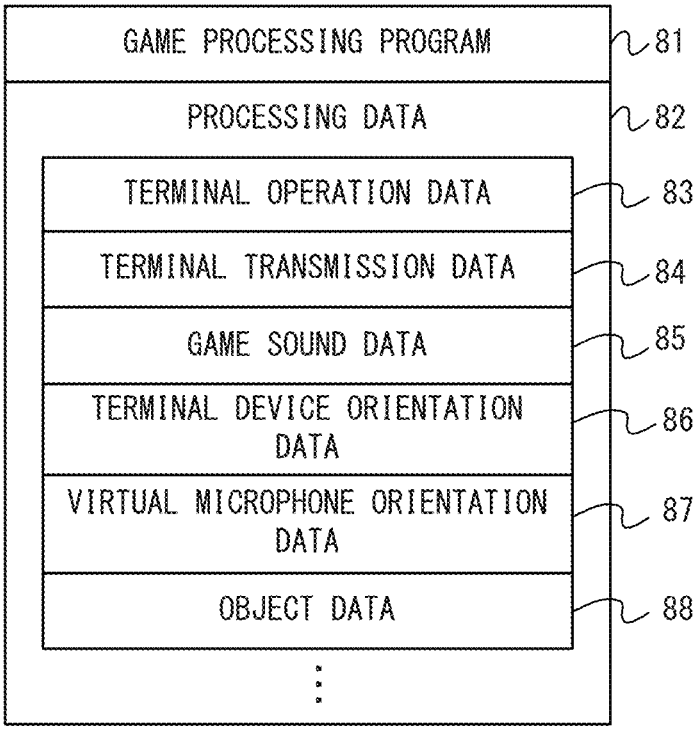
FIG. 13 is a non-limiting exemplary diagram showing the memory map of a memory 12.

FIG. 13 shows an example of various types of data to be stored in the memory 12 of the game apparatus body 5 when the above game is executed.

A game processing program 81 is a program for causing the CPU 11 of the game apparatus body 5 to execute the game processing for realizing the above game. The game processing program 81 is, for example, loaded from an optical disc onto the memory 12.

Processing data 82 is data used in game processing executed by the CPU 11. The processing data 82 includes terminal operation data 83, terminal transmission data 84, game sound data 85, terminal device orientation data 86, virtual microphone orientation data 87, object data 88, and the like.

Figure 14:
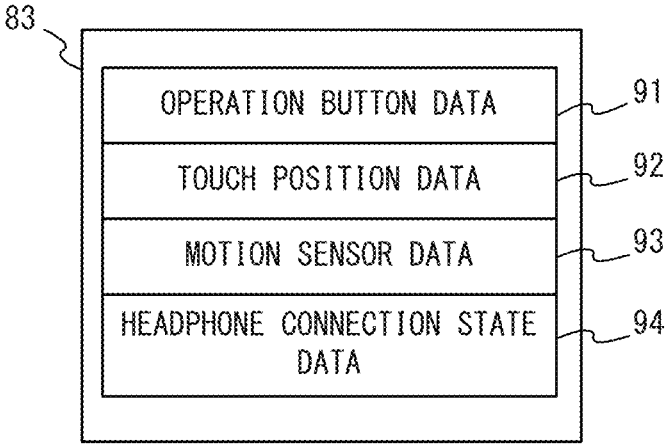
FIG. 14 is a diagram showing a non-limiting example of the configuration of terminal operation data 83.

The terminal operation data 83 is operation data periodically transmitted from the terminal device 6. FIG. 14 is a diagram showing an example of the configuration of the terminal operation data 83. The terminal operation data 83 includes operation button data 91, touch position data 92, motion sensor data 93, headphone connection state data 94, and the like. The operation button data 91 is data indicating the input state of the operation section 31 (analog stick 25, cross key 26, and button 27). In addition, the input content of the motion sensor 32 is also included in the operation button data 91. The touch position data 92 is data indicating the position (touched position) where an input is performed on the input surface of the touch panel 22. The motion sensor data 93 is data indicating the acceleration and the angular velocity which are respectively detected by the acceleration sensor and the angular velocity sensor included in the above motion sensor. The headphone connection state data 94 is data indicating whether or not a headphone is connected to the headphone jack 24.

Returning to FIG. 13, the terminal transmission data 84 is data periodically transmitted to the terminal device 6. The terminal transmission data 84 includes the terminal game image and the terminal game sound described above.

The game sound data 85 includes sources of the terminal game sound and the monitor game sound described above. For example, the game sound data 85 includes sounds such as a movement sound of a rocket as a sound emitted by the sound source object 102 as shown in FIG. 5 or the like.

The terminal device orientation data 86 is data indicating the orientation of the terminal device 6. The virtual microphone orientation data 87 is data indicating the orientation of the virtual microphone. These pieces of orientation data are represented as a combination of three-axis vector data. It is noted that the virtual microphone orientation data 87 includes orientation data of the terminal virtual microphone and orientation data of the monitor virtual microphone. It is noted that in the following description, in the case of simply mentioning "virtual microphone orientation data 87", it refers to orientation data of the terminal virtual microphone.

The object data 88 is data of the player character 101, the sound source object 102, and the like. Particularly, the data of the sound source object 102 includes information indicating sound data defined as a sound emitted by the sound source object. The sound data corresponds to one of the pieces of sound data included in the game sound data 85. Besides, the data of the sound source object 102 includes, as necessary, information about a sound emitted by the sound source object, such as information indicating whether or not the sound source object 102 is currently emitting a sound, and information defining the volume value of a sound emitted by the sound source object, the directionality of the sound, and the like.

Next, with reference to the flowcharts shown in FIGS. 15 and 16, a flow of the game processing executed by the CPU 11 of the game apparatus body 5 based on the game processing program 81 will be described.

Figure 15:
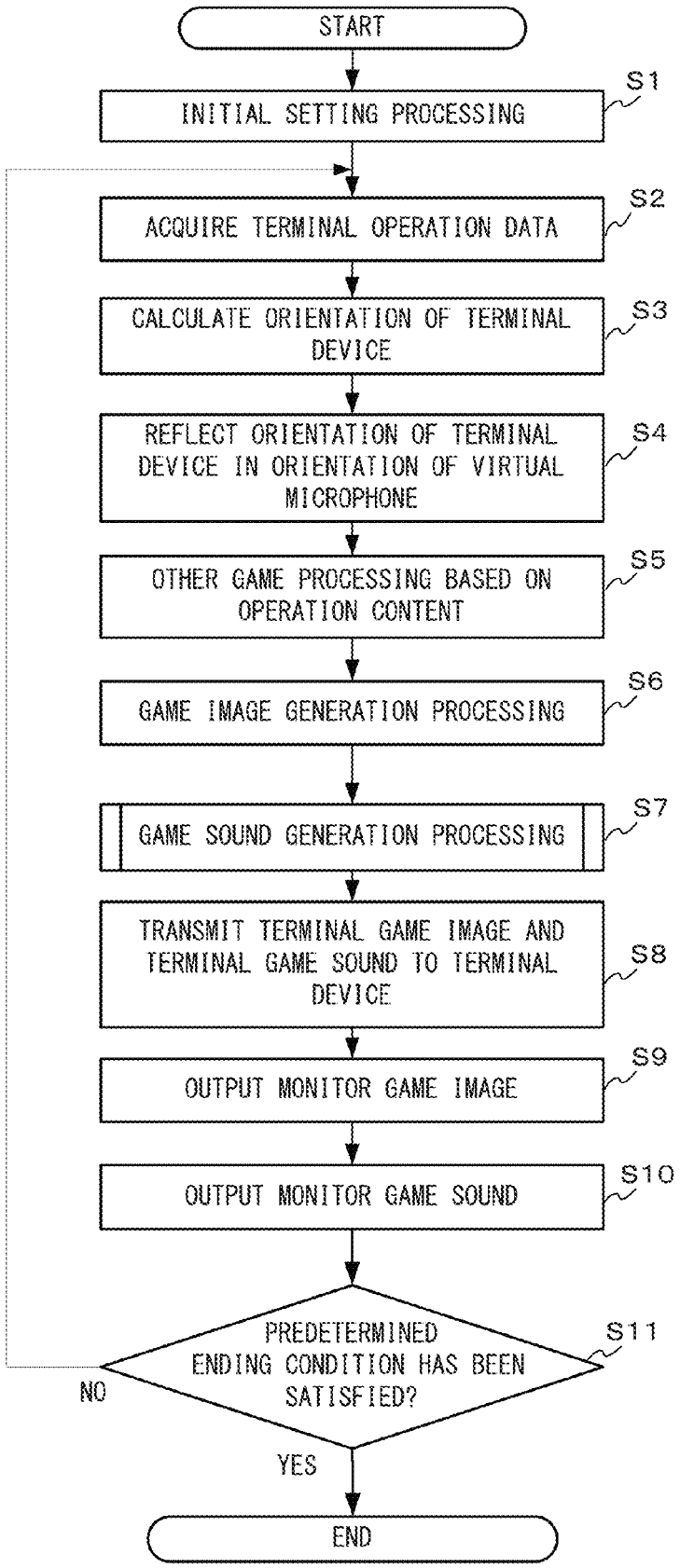
FIG. 15 is a non-limiting exemplary flowchart showing the flow of game processing based on a game processing program 81.
Figure 16:
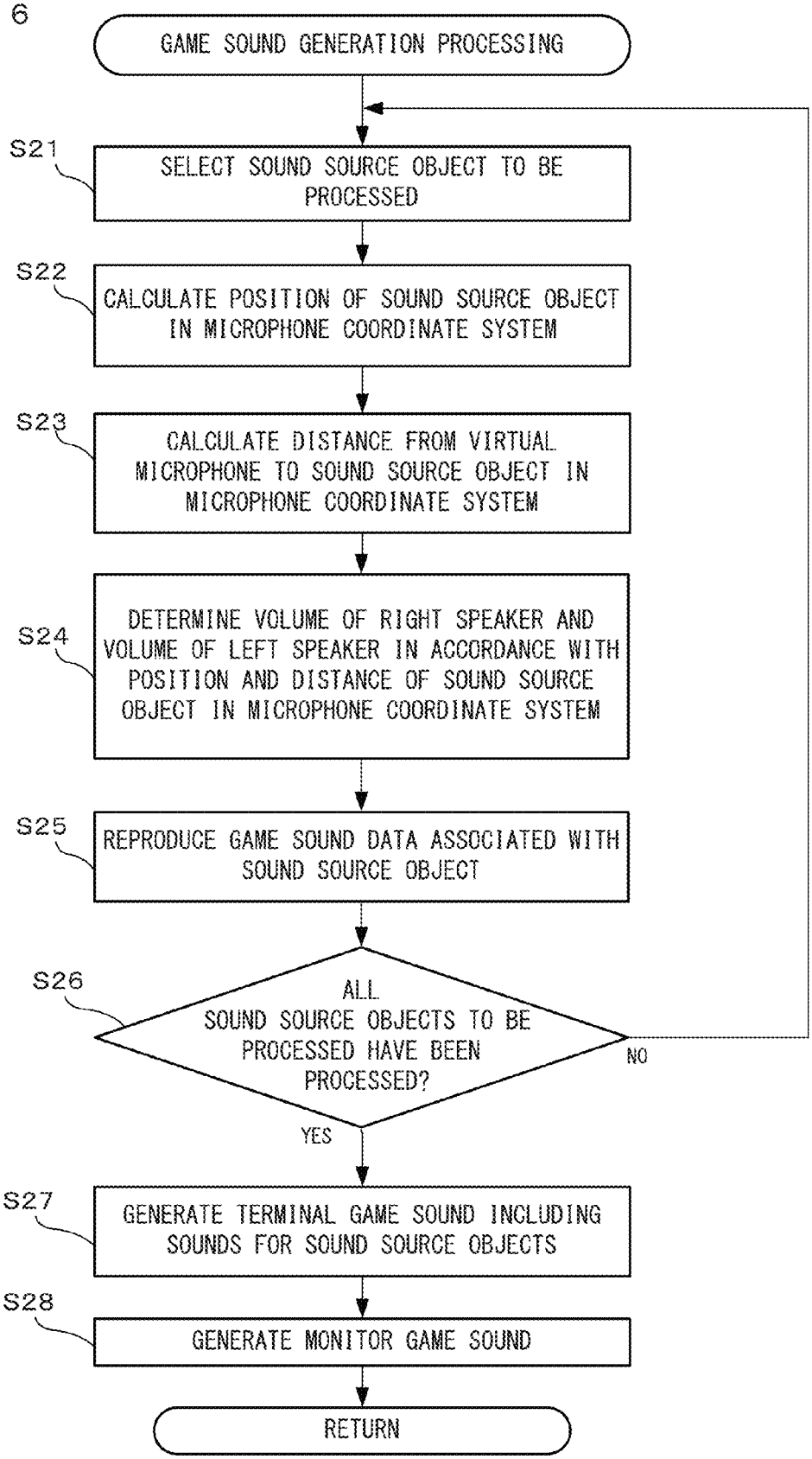
FIG. 16 is a non-limiting exemplary flowchart showing the details of game sound generation processing shown in FIG. 15.

In FIG. 15, when execution of the game processing program 81 is started, in step S1, the CPU 11 performs initialization processing. In the initialization processing, the orientations of the virtual microphones (virtual microphone orientation data 87) (for both terminal and monitor) are set at initial values. The initial value is a value corresponding to the state in which the directions of the axes in the microphone coordinate system respectively coincide with the directions of the axes in the space coordinate system of the virtual 3-dimensional space.

Next, in step S2, the CPU 11 acquires the terminal operation data 83.

Next, in step S3, the CPU 11 calculates the current orientation of the terminal device 6 based on the motion sensor data 93 (acceleration data and angular velocity data). Data indicating the calculated orientation is stored as the terminal device orientation data 86 into the memory 12.

Next, in step S4, the CPU 11 reflects the current orientation of the terminal device 6 in the orientation of the virtual microphone (terminal virtual microphone). Specifically, the CPU 11 reflects the orientation indicated by the terminal device orientation data 86 in the virtual microphone orientation data 87. It is noted that if a headphone is connected to the terminal device 6, the CPU 11, instead of reflecting the current orientation of the terminal device 6, adjusts the orientation of the virtual microphone so as to make the direction of the x axis in the microphone coordinate system of the virtual microphone coincide with the direction of the x axis in the space coordinate system of the virtual space. In other words, the orientation of the virtual microphone is adjusted so as to correspond to the state in which the loudspeakers 23L and 23R have a positional relationship of left-and-right arrangement. It is noted that whether or not a headphone is connected to the terminal device 6 can be determined by referring to the headphone connection state data 94. In addition, here, the orientation of the monitor virtual microphone is not changed.

Next, in step S5, the CPU 11 executes predetermined game processing based on an operation content indicated by the terminal operation data 83 (an operation content mainly indicated by the operation button data 91 or the touch position data 92). For example, processing of moving a variety of characters such as a player character or the above sound source object is performed.

Next, in step S6, the CPU 11 executes processing of generating a game image in which a result of the above game processing is reflected. For example, a game image is generated by taking, with a virtual camera, an image of the virtual game space in which the player character has moved based on the operation content. In addition, at this time, the CPU 11 generates two images of a monitor game image and a terminal game image as necessary in accordance with the game content. For example, these images are generated by using two virtual cameras.

Next, in step S7, the CPU 11 executes game sound generation processing for generating a monitor game sound and a terminal game sound. FIG. 16 is a flowchart showing the details of the game sound generation processing shown in the above step S7. In FIG. 16, first, in step S21, the CPU 11 selects one sound source object as a processing target. Thus, in the case where a plurality of sound source objects in the virtual space, these sound source objects are to be sequentially processed one by one. It is noted that the sound source object to be processed is, for example, a sound source object that is currently emitting a sound.

Next, in step S22, the CPU 11 calculates the position of the sound source object to be processed, in the microphone coordinate system. Thus, it can be recognized whether the sound source object is positioned on the right side or the left side of the virtual microphone in the microphone coordinate system.

Next, in step S23, the CPU 11 calculates the straight-line distance from the virtual microphone to the sound source object in the microphone coordinate system. In the subsequent step S24, the CPU 11 determines the volume values of the loudspeakers 23L and 23R based on the calculated position and distance of the sound source object in the microphone coordinate system. That is, the left-right volume balance between the loudspeakers 23L and 23R is determined.

Next, in step S25, the CPU 11 reproduces a piece of the game sound data 85 associated with the sound source object. The reproduction volume complies with the volume determined by the above step S24.

Next, in step S26, the CPU 11 determines whether or not all of the sound source objects to be processed have been processed as described above. If there is still a sound source object that has not been processed yet (NO in step S26), the CPU 11 returns to the above step S21 to repeat the above processing. On the other hand, if all of the sound source objects have been processed (YES in step S26), in step S27, the CPU 11 generates a terminal game sound including sounds according to the respective processed sound source objects.

In the subsequent step S28, the CPU 11 generates, as necessary, a monitor game sound in accordance with a result of the game processing, by using the monitor virtual microphone. Here, basically, the monitor game sound is generated for the loudspeakers 2L and 2R by the same processing as in the terminal game sound. Thus, the game sound generation processing is finished.

Returning to FIG. 15, in step S8 subsequent to the game sound generation processing, the CPU 11 stores the terminal game image generated in the above step S3 and the terminal game sound generated by the above step S7 into the terminal transmission data 84, and transmits the terminal transmission data 84 to the terminal device 6. Here, for convenience of the description, it is assumed that the transmission cycle of the terminal game sound coincides with the transmission cycle of the terminal game image, as an example. However, in another exemplary embodiment, the transmission cycle of the terminal game sound may be shorter than the transmission cycle of the terminal game image. For example, the terminal game image may be transmitted in a cycle of 1/60 second, and the terminal game sound may be transmitted in a cycle of 1/180 second.

Next, in step S9, the CPU 11 outputs the monitor game image generated in the above step S6 to the monitor 2. In the subsequent step S10, the CPU 11 outputs the monitor game sound generated in the above step S7 to the loudspeakers 2L and 2R.

Next, in step S11, the CPU 11 determines whether or not a predetermined condition for ending the game processing has been satisfied. As a result, if the predetermined condition has not been satisfied (NO in step S11), the process returns to the above step S2 to repeat the above-described processing. If the predetermined condition has been satisfied (YES in step S11), the CPU 11 ends the game processing.

Figure 17:
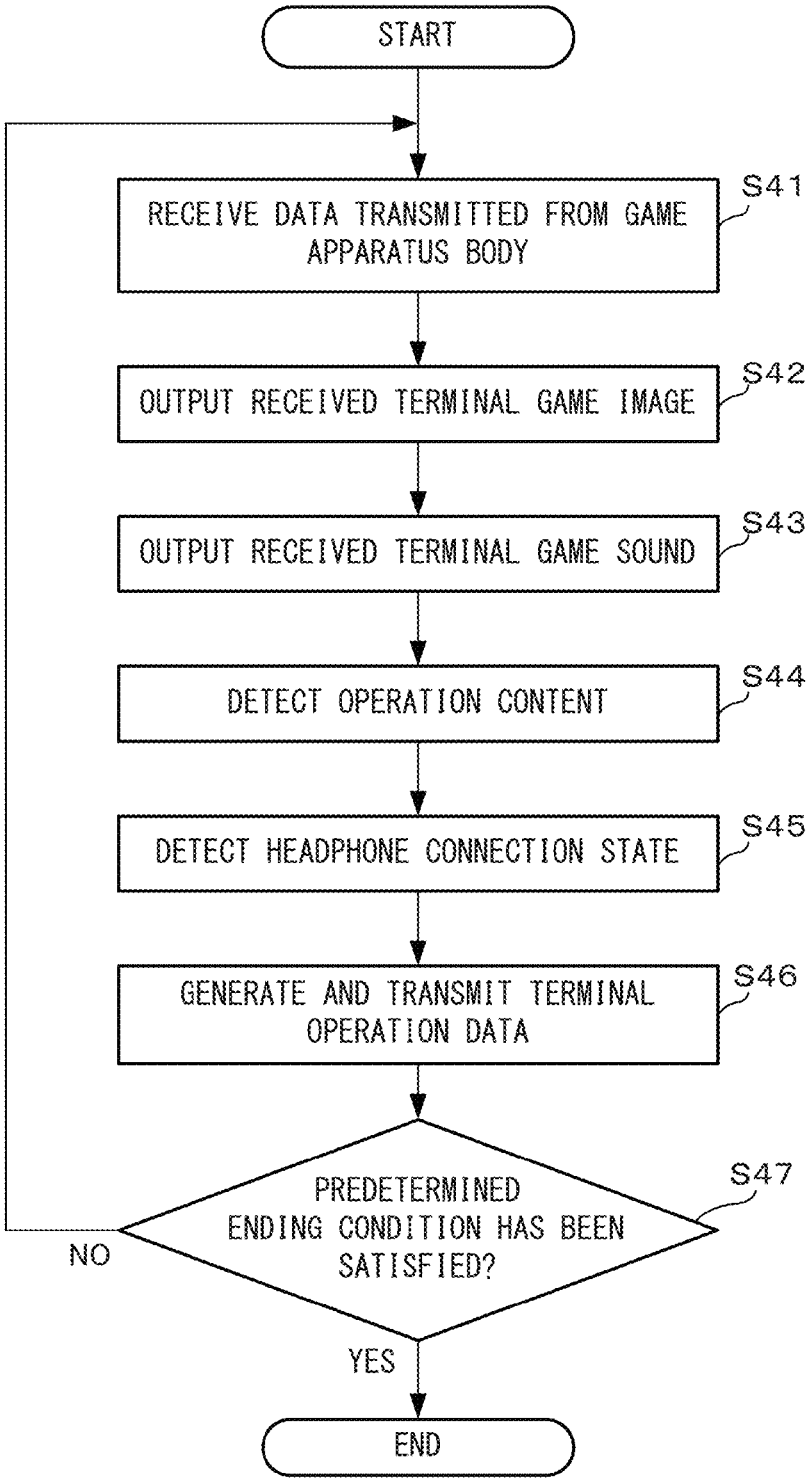
FIG. 17 is a non-limiting exemplary flowchart showing the flow of control processing of the terminal device 6.

Next, with reference to the flowchart in FIG. 17, a flow of control processing executed by the control section 33 of the terminal device 6 will be described. First, in step S41, the control section 33 receives the terminal transmission data 84 transmitted from the game apparatus body 5.

Next, in step S42, the control section 33 outputs, to the LCD 21, the terminal game image included in the received terminal transmission data 84.

Next, in step S43, the control section 33 outputs the terminal game sound included in the received terminal transmission data 84. If a headphone is not connected, the output destination is the loudspeakers 23L and 23R, and if a headphone is connected, the output destination is the headphone. In the case of outputting the terminal game sound to the loudspeakers 23L and 23R, the volume balance complies with the volume determined in the above step S24.

Next, in step S44, the control section 33 detects an input (operation content) to the operation section 31, the motion sensor 32, or the touch panel 22, and thereby generates the operation button data 91, the touch position data 92, and the motion sensor data 93.

Next, in step S45, the control section 33 detects whether or not a headphone is connected to the headphone jack 24, and then generates data indicating whether or not a headphone is connected, as the headphone connection state data 94.

Next, in step S46, the control section 33 generates the terminal operation data 83 including the operation button data 91, the touch position data 92, and the headphone connection state data 93 generated in the above steps S44 and S45, and transmits the terminal operation data 83 to the game apparatus body 5.

Next, in step S47, the control section 33 determines whether or not a predetermined condition for ending the control processing for the terminal device 6 has been satisfied (for example, whether or not a power-off operation has been performed). As a result, if the predetermined condition has not been satisfied (NO in step S47), the process returns to the above step S41 to repeat the above-described processing. If the predetermined condition has been satisfied (YES in step S47), the control section 33 ends the control processing for the terminal device 6.

As described above, in the exemplary embodiment, the output control for a sound emitted by a sound source object present in a virtual space is performed in consideration of the positional relationship between the loudspeakers 23L and 23R in the real space. Thus, in the game processing or the like using a display system for a virtual space as described above, an experience with a highly realistic sensation can be provided for a user.

It is noted that in the above exemplary embodiment, "horizontal orientation" and "vertical orientation" have been used as an example of change in the orientation of the terminal device 6. That is, change in the orientation on the xy plane in the coordinate system of the terminal device 6 (turn around the z axis) has been shown as an example. However, the change manner of the orientation is not limited thereto. The above processing can be also applied to the case of orientation change such as turn around the x axis or the y axis. For example, in the virtual space, it will be assumed that there is a sound source object moving in the positive direction of the z axis (that is, a sound source object moving away in the depth direction as seen from a player). In this case, if the terminal device 6 is in "horizontal orientation" shown in FIG. 5 or "vertical orientation" shown in FIG. 7, the left-right volume balance between the loudspeakers 23L and 23R is not changed with respect to a sound emitted by the sound source object. However, for example, it will be assumed that from the state shown in FIG. 7, a player turns the terminal device 6 around the y axis in the terminal device coordinate system so that the LCD 21 faces upward. In this case, in accordance with the movement of the sound source object in the depth direction, the volume balance between the loudspeakers 23L and 23R changes. That is, the sound output control is performed so as to gradually decrease the volume of the loudspeaker 23L while gradually increasing the volume of the loudspeaker 23R.

In the above exemplary embodiment, a game system having two screens and two sets of stereo speakers (four loudspeakers), i.e., the monitor 2 and the terminal device 6 has been shown as an example. However, instead of such a configuration, for example, the above processing can be also applied to an information processing apparatus having a screen and stereo speakers, which are integrated with a housing thereof, such as a hand-held game apparatus. In addition, it is preferable that such an information processing apparatus has a motion sensor therein and thus capable of detecting the orientation of the information processing apparatus. Then, processing using a display system for a virtual space as described above can be preferably performed on such an information processing apparatus. In this case, the same processing as described above may be performed using just one virtual camera and one virtual microphone.

Figure 18:
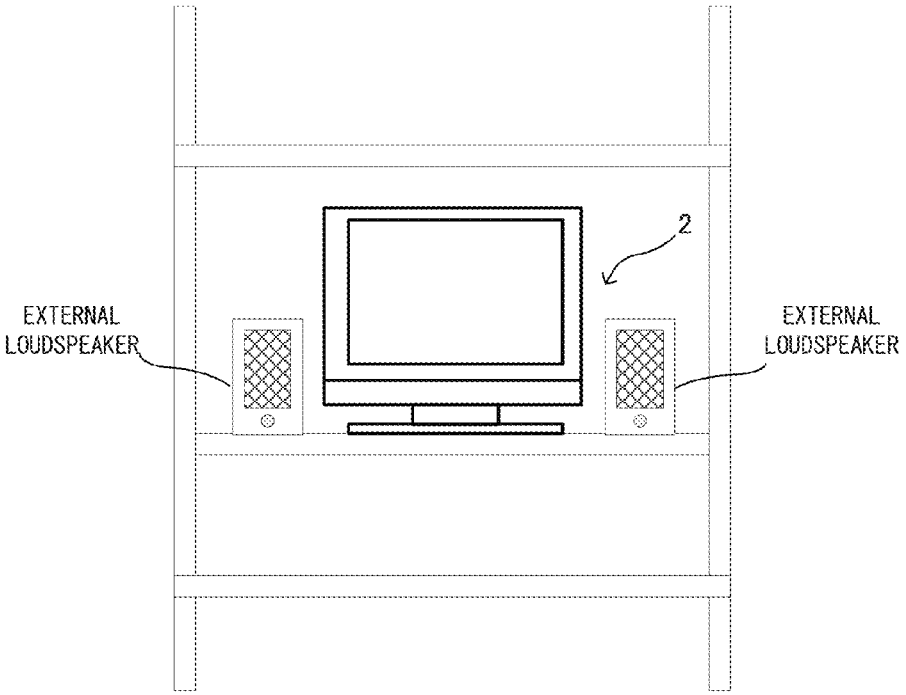
FIG. 18 is a diagram showing a non-limiting example of arrangement of external loudspeakers.
Figure 19:
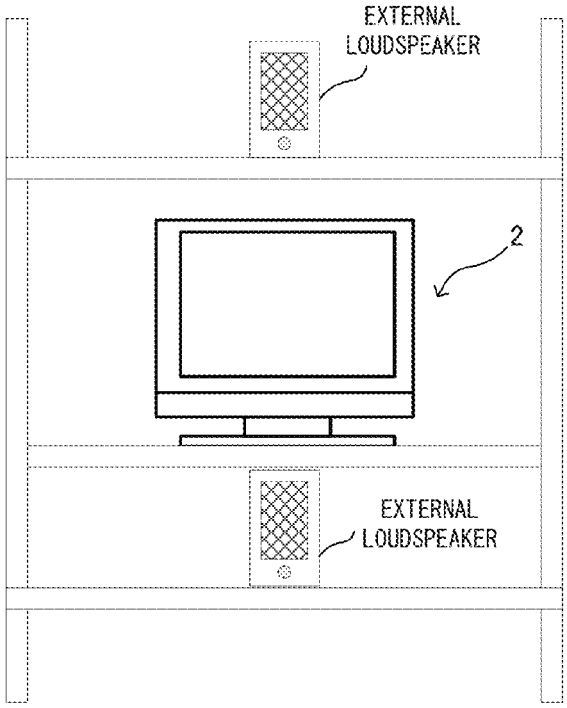
FIG. 19 is a diagram showing a non-limiting example of arrangement of external loudspeakers.

In addition, the above processing can be also applied to a stationary game apparatus that does not use a game controller having a screen and a loudspeaker as shown by the terminal device 6. For example, it is conceivable that a game is played with external stereo speakers connected to the monitor 2. FIGS. 18 and 19 are schematic diagrams showing the positional relationships between a monitor and external loudspeakers in such a configuration. FIG. 18 shows an example in which external loudspeakers (right loudspeaker and left loudspeaker) are placed on the right and the left of the monitor 2. In addition, FIG. 19 shows an example in which external loudspeakers are placed above and below the monitor 2. If the game apparatus can recognize the positional relationships between such external loudspeakers, the above processing can be applied. For example, upon execution of game processing, a player may set, for the game apparatus, information about whether the arrangement relationship between the external loudspeakers is "above-and-below arrangement" or "right-and-left arrangement" (for example, a predetermined setting screen may be displayed to allow a player to input such information), whereby the game apparatus may recognize the positional relationship between the external loudspeakers. Alternatively, a predetermined sensor (for example, an acceleration sensor) capable of recognizing the positional relationship between the external loudspeakers may be provided inside the external loudspeakers. Then, based on the output result of the sensor, the game apparatus may automatically recognize the positional relationship between the external loudspeakers. In addition, also in the case of using, for example, loudspeakers of 5.1 ch surround system as external loudspeakers, the same processing can be applied. It will be assumed that the arrangement of 5.1 ch loudspeakers is changed from the basic arrangement, that is, for example, the left and right front loudspeakers are changed into an above-and-below positional relationship. Also in this case, by causing the game apparatus to recognize the positional relationship between the loudspeakers (recognize the change in the positional relationship), the volumes of the loudspeakers may be adjusted while reflecting the positional relationship between a sound source object and each loudspeaker in the adjustment.

Figure 20:
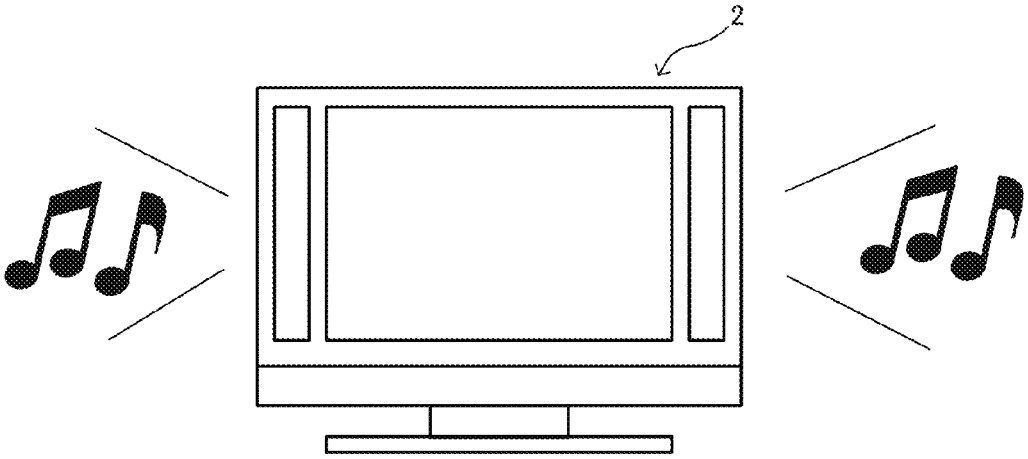
FIG. 20 is a diagram showing a non-limiting example of the output state of a game sound.
Figure 20:
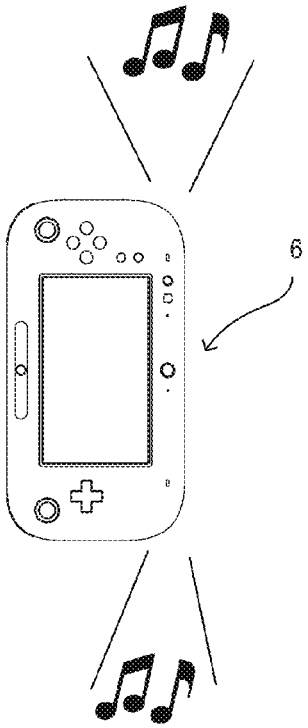

The above processing may be applied by using all of two sets of stereo loudspeakers (a total of four loudspeakers), i.e., the loudspeakers 2L and 2R of the monitor 2 and the loudspeakers 23L and 23R of the terminal device 6. Particularly, such application is suitable for the case of using the terminal device 6 mainly in "vertical orientation". FIG. 20 is a diagram schematically showing sound output in such a configuration. For example, movement of a sound source object in the right-left direction in a virtual space is reflected in outputs from the loudspeakers 2L and 2R of the monitor 2. In addition, movement of a sound source object in the up-down direction is reflected in outputs from the loudspeakers 23L and 23R of the terminal device 6. Thus, movement of a sound source object in four directions of up, down, right and left, is reflected in volume change, thereby enhancing a realistic sensation.

In addition, the game processing program for executing processing according to the above exemplary embodiment can be stored in any computer-readable storage medium (for example, a flexible disc, a hard disk, an optical disc, a magnet-optical disc, a CD-ROM, a CD-R, a magnetic tape, a semiconductor memory card, a ROM, a RAM or the like).

In the above exemplary embodiment, the case of performing game processing has been described as an example. However, the information processing is not limited to game processing. The processing of the above exemplary embodiment can be also applied to another information processing using such a display system for a virtual space as described above.

In the above exemplary embodiment, the case where a series of processing steps for performing sound output control in consideration of the positional relationship between loudspeakers in the real space is executed by a single apparatus (game apparatus body 5), has been described. However, in another exemplary embodiment, the series of processing steps may be executed in an information processing system composed of a plurality of information processing apparatuses. For example, in an information processing system including the game apparatus body 5 and a server-side apparatus capable of communicating with the game apparatus body 5 via a network, some of the series of processing steps may be executed by the server-side apparatus. Alternatively, in this information processing system, a system on the server side may be composed of a plurality of information processing apparatuses, and the processing steps to be executed on the server side may be executed being divided by the plurality of information processing apparatuses.

What is claimed is:

1. An information processing system including a processor system including at least one processor and a plurality of sound output sections, the processor system being configured to at least:

recognize the positional relationship among the plurality of sound output sections;

generate a sound corresponding to a sound source object present in a virtual space, based on predetermined information processing; and cause each of the plurality of sound output sections to output the generated sound therefrom, and determine, for each of the plurality of sound output sections, the output volume of the sound corresponding to the sound source object in accordance with the positional relationship among the plurality of sound output sections.

2. The information processing system according to claim 1, further comprising:

a first output apparatus having: a housing; a first display section and the plurality of sound output sections, which are integrated with the housing; and a motion sensor capable of detecting the motion of the first output apparatus, wherein the processor system is further configured to detect the orientation of the first output apparatus based on an output from the motion sensor, the positional relationship among the plurality of sound output sections is recognized based on the detected orientation of the first output apparatus, and the output volume of each sound output section is determined based on the positional relationship among the plurality of sound output sections recognized based on the orientation of the first output apparatus.

3. The information processing system according to claim 2, wherein the processor system executes predetermined information processing in the state in which the axis directions in the coordinate system of the virtual space coincide with the axis directions in the coordinate system of the real space, the virtual space containing the sound source object is displayed on the first display section, and the output volume is set such that, the closer the sound output section is to a position in the real space corresponding to the position of the sound source object in the virtual space, the larger the output volume of the sound output section is, and such that, the farther the sound output section is from the position in the real space, the smaller the output volume of the sound output section is.

4. The information processing system according to claim 2, further comprising a second output apparatus having: a plurality of sound output sections different from the plurality of sound output sections provided on the first output apparatus; and a second display section, wherein the output volume of each sound output section is determined in accordance with the positional relationship among the plurality of sound output sections of the first output apparatus and the plurality of sound output sections of the second output apparatus.

5. The information processing system according to claim 2, wherein the first output apparatus further has a headphone connector to which a headphone can be connected, the processor system is further configured to detect whether or not a headphone is connected to the first output apparatus, wherein, when it is detected that a headphone is connected to the first output apparatus, the output volume is determined, regarding the positional relationship among the plurality of sound output sections as being a predetermined positional relationship, irrespective of the orientation of the first output apparatus.

6. A computer-readable non-transitory storage medium having stored therein an information processing program to be executed by a computer in an information processing system that includes a predetermined information processing section and a plurality of sound output sections, the information processing program causing the computer to execute:

recognizing the positional relationship among the plurality of sound output sections;

generating a sound corresponding to a sound source object present in a virtual space, based on predetermined information processing; and causing each of the plurality of sound output sections to output the generated sound therefrom, and determining, for each of the plurality of sound output sections, the output volume of the sound corresponding to the sound source object in accordance with the positional relationship among the plurality of sound output sections.

7. The computer-readable non-transitory storage medium according to claim 6, wherein the information processing system further includes a first output apparatus having: a housing; a first display section and the plurality of sound output sections, which are integrated with the housing; and a motion sensor capable of detecting the motion of the first output apparatus, the information processing program further causing the computer to execute detecting the orientation of the first output apparatus based on an output from the motion sensor, wherein the positional relationship among the plurality of sound output sections is recognized based on the detected orientation of the first output apparatus, and the output volume of each sound output section is determined based on the positional relationships among the plurality of sound output sections recognized based on the orientation of the first output apparatus.

8. An information processing control method for controlling an information processing system that includes a predetermined information processing section and a plurality of sound output sections, the information processing control method comprising:

recognizing the positional relationship among the plurality of sound output sections;

generating a sound corresponding to a sound source object present in a virtual space, based on predetermined information processing; and causing each of the plurality of sound output sections to output the generated sound therefrom, while determining, for each of the plurality of sound output sections, the output volume of the sound corresponding to the sound source object in accordance with the positional relationship among the plurality of sound output sections.

9. The information processing control method according to claim 8, wherein the information processing system further includes a first output apparatus having: a housing; a first display section and the plurality of sound output sections, which are integrated with the housing; and a motion sensor capable of detecting the motion of the first output apparatus, the information processing control method further comprising detecting the orientation of the first output apparatus based on an output from the motion sensor, wherein in the positional relationship recognizing step, recognizing the positional relationship among the plurality of sound output sections based on the detected orientation of the first output apparatus, and in the generated sound output step, determining the output volume of each sound output section based on the positional relationship among the plurality of sound output sections recognized based on the orientation of the first output apparatus.

10. An information processing apparatus capable of outputting a sound signal to a plurality of sound output sections, the information processing apparatus comprising:

a positional relationship recognizer configured to recognize the positional relationship among the plurality of sound output sections;

a sound generator configured to generate a sound corresponding to a sound source object present in a virtual space, based on predetermined information processing; and a sound output controller configured to cause each of the plurality of sound output sections to output the generated sound therefrom, and configured to determine, for each of the plurality of sound output sections, the output volume of the sound corresponding to the sound source object in accordance with the positional relationship among the plurality of sound output sections.

11. The information processing apparatus according to claim 10, wherein the information processing apparatus has: a housing; a display section; a motion sensor; and an orientation detector configured to detect the orientation of the information processing apparatus based on an output from the motion sensor, the display section and the plurality of sound output sections are provided being integrated with the housing, the positional relationship recognizer recognizes the positional relationship among the plurality of sound output sections based on the detected orientation of the information processing apparatus, and the sound output controller determines the output volume of each sound output section based on the positional relationships among the plurality of sound output sections recognized based on the orientation of the information processing apparatus.

12. The information processing apparatus according to claim 10, wherein the information processing apparatus is connectable to a first output apparatus having: a housing; a first display section and the plurality of sound output sections, which are integrated with the housing; and a motion sensor capable of detecting the motion of the first output apparatus, the information processing apparatus further comprising an orientation detector configured to detect the orientation of the first output apparatus based on an output from the motion sensor, wherein the positional relationship recognizer recognizes the positional relationship among the plurality of sound output sections based on the detected orientation of the first output apparatus, and the sound output controller determines the output volume of each sound output section based on the positional relationship among the plurality of sound output sections recognized based on the orientation of the first output apparatus.

* * * * *